US010930488B2

(12) United States Patent
Furuhashi et al.

(10) Patent No.: US 10,930,488 B2
(45) Date of Patent: Feb. 23, 2021

(54) MASS SPECTROMETER, SAMPLING PROBE, AND ANALYSIS METHOD

(71) Applicant: SHIMADZU CORPORATION, Kyoto (JP)

(72) Inventors: Osamu Furuhashi, Kyoto (JP); Tomomi Tamura, Kyoto (JP); Kiyoshi Ogawa, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/814,036

(22) Filed: Mar. 10, 2020

(65) Prior Publication Data

US 2020/0328071 A1 Oct. 15, 2020

(30) Foreign Application Priority Data

Apr. 11, 2019 (JP) ..... JP2019-075777

(51) Int. Cl.
*H01J 49/00* (2006.01)
*H01J 49/08* (2006.01)
*H01J 49/04* (2006.01)

(52) U.S. Cl.
CPC ..... *H01J 49/08* (2013.01); *H01J 49/0422* (2013.01)

(58) Field of Classification Search
CPC ..... H01J 49/08; H01J 49/0422
USPC ..... 250/281, 282, 283, 288
See application file for complete search history.

(56) References Cited

U.S. PATENT DOCUMENTS 6,703,610 B2 3/2004 Mordehai
8,076,639 B2 * 12/2011 Cooks ..... H01J 49/14 250/288
2006/0255261 A1 * 11/2006 Whitehouse ..... H01J 49/0431 250/288
2009/0008571 A1 * 1/2009 Matsuura ..... H01J 27/24 250/427
2011/0031392 A1 * 2/2011 McEwen ..... H01J 49/107 250/283

FOREIGN PATENT DOCUMENTS

EP 3 605 584 A1 2/2020
JP 2018-156904 A 10/2018
JP 2018-205126 A 12/2018

OTHER PUBLICATIONS

Tadashi Iwamatsu et al., "Novel Charging System by Electron Emission Device in the Atmosphere", Journal of The Imaging Society of Japan, 2017, pp. 16-23, vol. 56, No. 1.
Evan L. Neidholdt et al., "Compact Ambient Pressure Pyroelectric Ion Source for Mass Spectrometry", Analytical Chemistry, May 15, 2007, pp. 3945-3948, vol. 79, No. 10.

* cited by examiner

*Primary Examiner* — Nicole M Ippolito
(74) *Attorney, Agent, or Firm* — Sughrue Mion, PLLC

(57) ABSTRACT

A mass spectrometer, includes: a sampling probe that irradiates a specimen disposed in the atmosphere with an electron and obtains a sample separated from the specimen; and a measurement unit that performs mass spectrometry of the sample obtained by the sampling probe, wherein the sampling probe comprises: a casing having an opening which is opened to the atmosphere and an outlet through which the sample is discharged to the measurement unit; and a surface emission type electron emission element housed in the casing such that an electron emission surface thereof opposes to the opening.

11 Claims, 13 Drawing Sheets

(FIRST EMBODIMENT)

1

(VARIATION 2)

(VARIATION 2)

(VARIATION 4)

(SECOND EMBODIMENT)

(VARIATION 5)

(VARIATION 6)

(THIRD EMBODIMENT)

1

MASS SPECTROMETER, SAMPLING PROBE, AND ANALYSIS METHOD

INCORPORATION BY REFERENCE

The disclosure of the following priority application is herein incorporated by reference: Japanese Patent Application No. 2019-075777 filed Apr. 11, 2019

TECHNICAL FIELD

The present invention relates to a mass spectrometer, a sampling probe, and an analysis method.

BACKGROUND ART

A mass spectrometer includes an ionization unit that ionizes a target specimen and a mass separation unit that separates ions according to m/z. As a mass spectrometer for analyzing a solid specimen, a mass spectrometer using laser desorption ionization (LDI) or a secondary-ion mass spectrometry (SIMS) have been known. A mass spectrometer using the laser desorption ionization (for example, PTL 1) requires a laser light source, and a mass spectrometer using the secondary-ion mass spectrometry (for example, PTL 2) requires an ion source.

CITATION LIST

Patent Literature

PTL1: Japanese Laid Open Patent Publication No. 2018-156904

PTL2: Japanese Laid Open Patent Publication No. 2018-205126

SUMMARY OF INVENTION

Technical Problem

Each of the above-mentioned mass spectrometers requires a laser light source or an ion source. Thus, the size of the mass spectrometer increases, and a solid specimen is required to be placed in a vacuum chamber.

Solution to Problem

According to the first aspect of the present invention, a mass spectrometer comprises: a sampling probe that irradiates a specimen disposed in the atmosphere with an electron and obtains a sample desorbed from the specimen; and a measurement unit that performs mass spectrometry of the sample obtained by the sampling probe, wherein the sampling probe includes: a casing having an opening which is opened to the atmosphere and an outlet through which the sample is discharged to the measurement unit; and a surface emission type electron emission element housed in the casing such that an electron emission surface thereof opposes to the opening.

According to the second aspect of the present invention, a sampling probe comprises: a casing having an opening that is opened to the atmosphere and an outlet through which a sample that has been obtained is discharged; and a surface emission type electron emission element housed in the casing such that an electron emission surface thereof opposes to the opening.

According to the third aspect of the present invention, an analysis method comprises: placing a probe having an electron source so as to oppose to a specimen that is disposed in the atmosphere; irradiating the specimen with an electron emitted from the electron source; introducing a sample detached from the specimen to an analyzer; and analyzing the introduced sample.

Advantageous Effects of Invention

According to the present invention, a compact mass spectrometer by which sampling from a specimen can be performed under atmospheric pressure can be provided.

DESCRIPTION OF EMBODIMENTS

The embodiments of the present invention are described below with reference to the drawings.

First Embodiment

Figure 1:
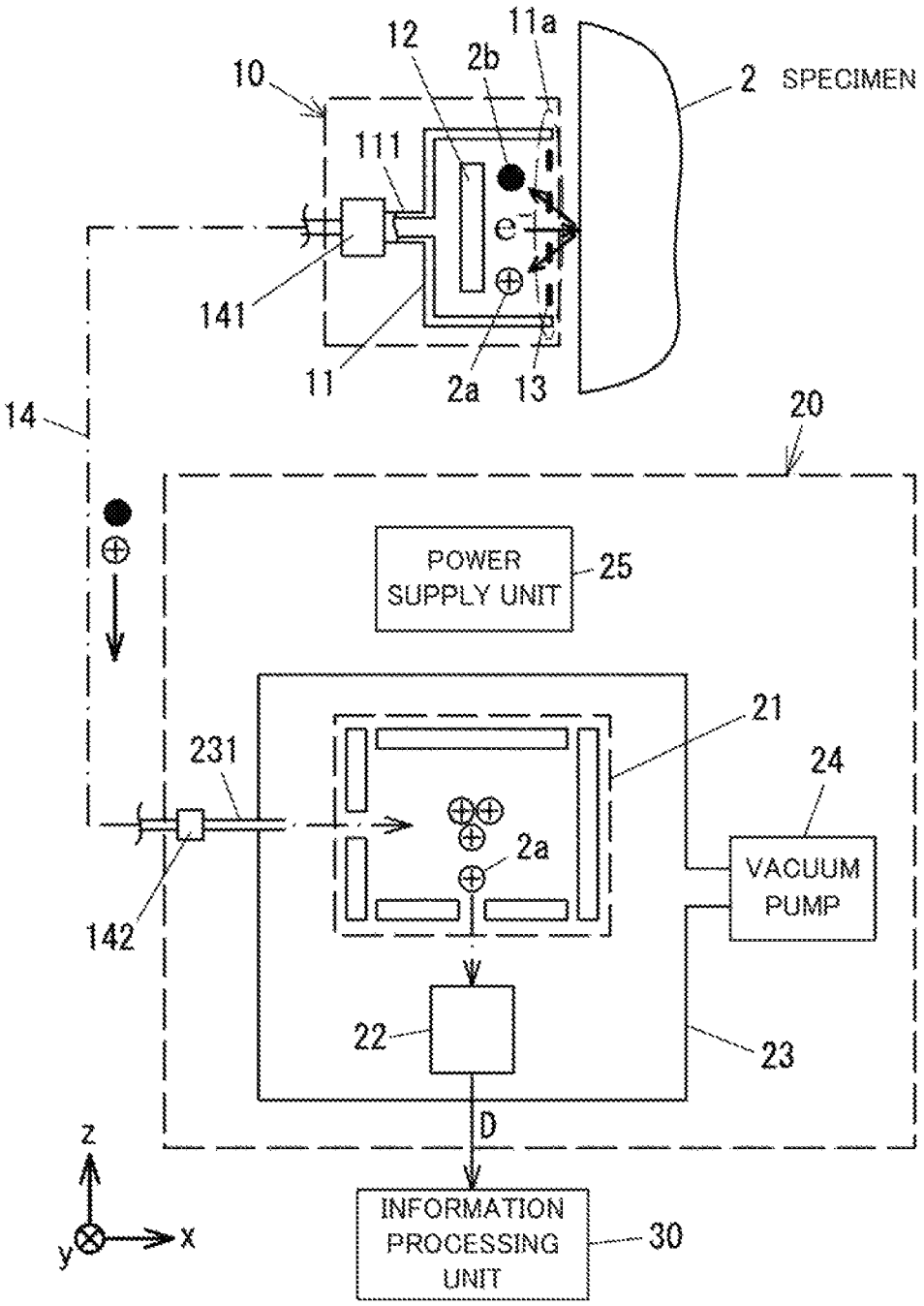
FIG. 1 is a schematic view explaining the first embodiment and illustrating a conceptual configuration of a mass spectrometer.

FIG. 1 is a schematic view explaining the first embodiment and illustrating a conceptual configuration of a mass spectrometer. A mass spectrometer 1 includes a sampling probe 10 that obtains a sample from a solid specimen 2 to be measured, a measurement unit 20, and an information processing unit 30.

The sampling probe 10 includes a casing 11, an electron source 12 housed in the casing 11, a counter electrode 13 provided at an opening 11*a* of the casing 11. As will be described later, the electron source 12 can emit electrons under atmospheric pressure and can be, for example, a surface emission type electron emission element such as described later. As will be described in detail later, in an example shown in FIG. 1, the sampling probe 10 obtains samples of ions 2*a* and detached neutral particles 2*b* emitted from the surface of the specimen 2 by electron irradiation. Obtained ions 2*a* and detached neutral particles 2*b* are discharged from an outlet 111 formed to the casing 11.

The measurement unit 20 includes: an ion trap type mass separation unit 21, a detection unit 22 that detects the ions 2*a* discharged from the mass separation unit 21, a vacuum chamber 23 housing the mass separation unit 21 and the detection unit 22, a vacuum pump 24 that evacuates an inside of the vacuum chamber 23, and a power supply unit 25. As will be described later, the power supply unit 25 applies a voltage to the electron source 12 of the sampling probe 10 and electrodes of the mass separation unit 21.

The vacuum chamber 23 is provided with an inlet 231 for introducing a specimen from the sampling probe 10. The inlet 231 and the outlet 111 of the sampling probe 10 are connected to each other by a tube 14 for transferring a sample. The tube 14 is detachably attached to the inlet 231 and the outlet 111 through couplings 141 and 142 respectively. Air in the vacuum chamber 23 is evacuated by a vacuum pump 24 so that the vacuum chamber 23 is in a desired vacuum state (at a mass spectrometry operating pressure). The ions 2*a* and the detached neutral particles 2*b* obtained by the sampling probe 10 are transferred through the outlet 111, the tube 14, the inlet 231, and the vacuum chamber 23 by an air flow generated by diffusion of the ions 2*a* and the detached neutral particles 2*b* and the differential pressure between the inside of the vacuum chamber 23 and the inside of the casing 11.

The inner diameter of the inlet 231 provided in the vacuum chamber 23 is extremely small so that the degree of vacuum in the vacuum chamber 23 is not deteriorated and is, for example, about 0.1 mm. Although the material of the tube 14 is not particularly limited, the tube 14 preferably has a structure with which ions 2*a* are less prone to be neutralized. For example, in order not to retain ions 2*a* in a transfer passage, it is preferred that the tube 14 and the couplings 141 and 142 are configured such that the inner diameters are substantially identical, and their inner surfaces are almost connected to each other without a gap.

The tube 14 is detachably connected to the outlet 111 and the inlet 231 through the couplings 141 and 142 respectively, so that the sampling probe 10 can be easily detached and attached to the measurement unit 20. When the sampling probe 10 is detached in non-use, the mass spectrometer can be easily handled. As a matter of course, the tube 14 may be connected integrally to the outlet 111 and the inlet 231 without the couplings 141 and 142.

Among the ions 2*a* and the detached neutral particles 2*b* transferred to the vacuum chamber 23, charged ions 2*a* are trapped in an area between the electrodes of the mass separation unit 21 once, and ions are discharged to the detection unit 22 according to the voltage applied to the electrodes. The mass separation unit 21 will be described in detail later. The detection unit 22 includes an ion detector such as a Faraday cup, and detects ions mass separated in the mass separation unit 21. Measurement data D for magnitude of detection signals obtained at the respective times are A/D converted using an A/D converter (not shown) and are thereafter output to an information processing unit 30.

The information processing unit 30 includes an information processing device such as a personal computer (hereinafter referred to as PC). The information processing unit 30 performs control of the measurement unit 20, analysis of the measurement data D, and the like using the processor including CPU and the like. The method of the analysis of the measurement data D is not particularly limited, and the information processing unit 30 can create data corresponding to a mass spectrum and can calculate the amount of molecules having a specific m/z in the specimen 2 or the like on the basis of the magnitude of the detected signal corresponding to the m/z.

The information processing unit 30 includes an input devices such as a mouse, a keyboard, and a touch panel, and the processor receives input by the user via the input device. The information processing unit 30 includes a display device such as a liquid crystal monitor, and the processor lets the display device information obtained by the analysis and the like. Although the mass spectrometer 1 includes the information processing unit 30 in the configuration of the present embodiment, the mass spectrometer 1 may not include the information processing unit 30, i.e., may include the sampling probe 10 and the measurement unit 20.

Mass Separation Unit 21

Figure 2:
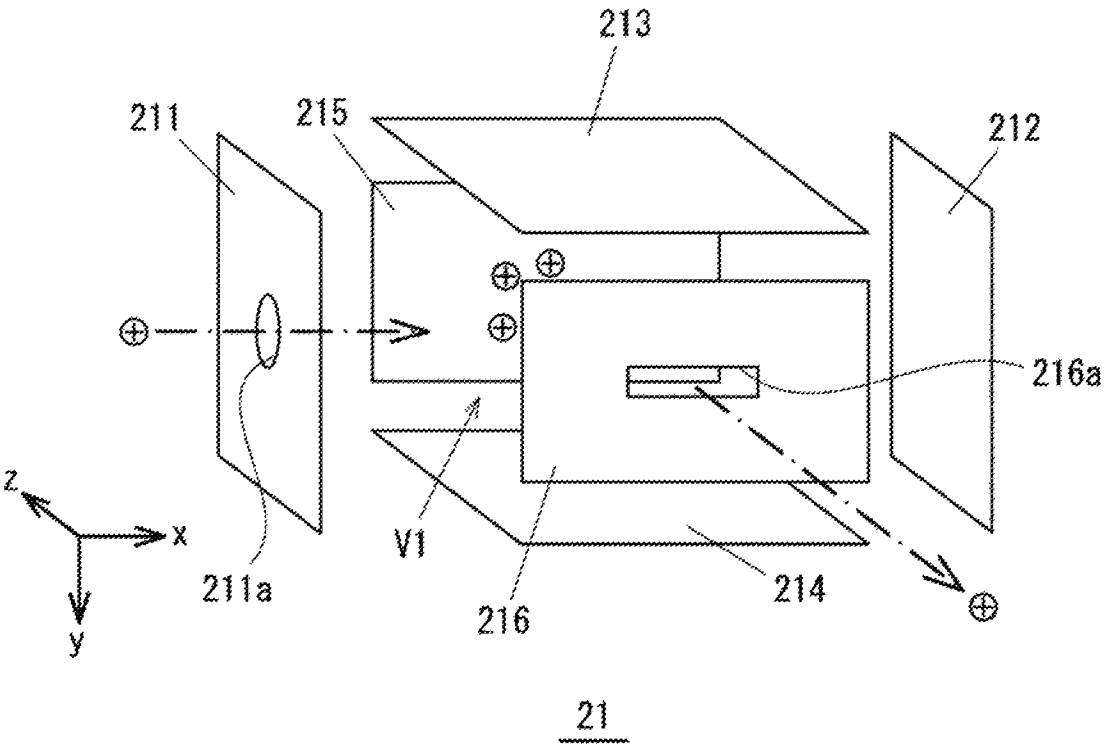
FIG. 2 is a schematic view of a mass separation unit.

FIG. 2 is a perspective view schematically illustrating an ion trap type mass separation unit 21. The mass separation unit 21 includes a first electrode 211, a second electrode 212, a third electrode 213, a fourth electrode 214, a fifth electrode 215, and a sixth electrode 216, each having a plate-like shape. The first electrode 211 and the second electrode 212 are disposed to face each other in substantially parallel to the yz plane. The third electrode 213 and the fourth electrode 214 are disposed to face each other in substantially parallel to the zx plane. The fifth electrode 215 and the sixth electrode 216 are disposed to face each other in substantially parallel to the xy plane.

Ions 2*a* are trapped in a space V1 surrounded by a first electrode 211, a second electrode 212, a third electrode 213, a fourth electrode 214, a fifth electrode 215, and a sixth electrode 216. A DC voltage is applied by a direct-current power supply (not shown) provided in the power supply unit 25 to the first electrode 211 and the second electrode 212. In the case where the ions 2*a* to be detected are cations, the DC voltage is set to the voltage that is several tens of volts higher than the average voltage of the third electrode 213, the fourth electrode 214, the fifth electrode 215, and the sixth electrode 216. On the other hand, in the case in which the ions 2*a* to be detected are anions, the DC voltage is set to the voltage that is several tens of volts lower than the above-mentioned average voltage. Accordingly, the first electrode 211 and the second electrode 212 function as a push-back electrodes for easily retaining the ions 2*a* in the space V1.

An AC voltage is applied by an AC power supply (not shown) provided in the power supply unit 25 to the third electrode 213, the fourth electrode 214, the fifth electrode 215, and the sixth electrode 216. The amplitude and the phase of the voltage applied to each electrode are adjusted so that the ions 2*a* are periodically moved by the AC voltage in the space V1 and thereby the ions 2*a* are trapped in the space V1.

The ions 2*a* introduced from the inlet 231 in FIG. 1 to the vacuum chamber 23 are introduced into the mass separation unit 21 through an opening 211*a* formed to the first electrode 211. The ions 2*a* introduced into the mass separation unit 21 are once trapped in the space V1. Then, by gradually adjusting the AC voltage, ions 2*a* which not to meet trap requirements are discharged from a slit 216*a* formed to the sixth electrode 216 and are then detected by the detection unit 22 of FIG. 1.

Sampling Probe 10

Figure 3:
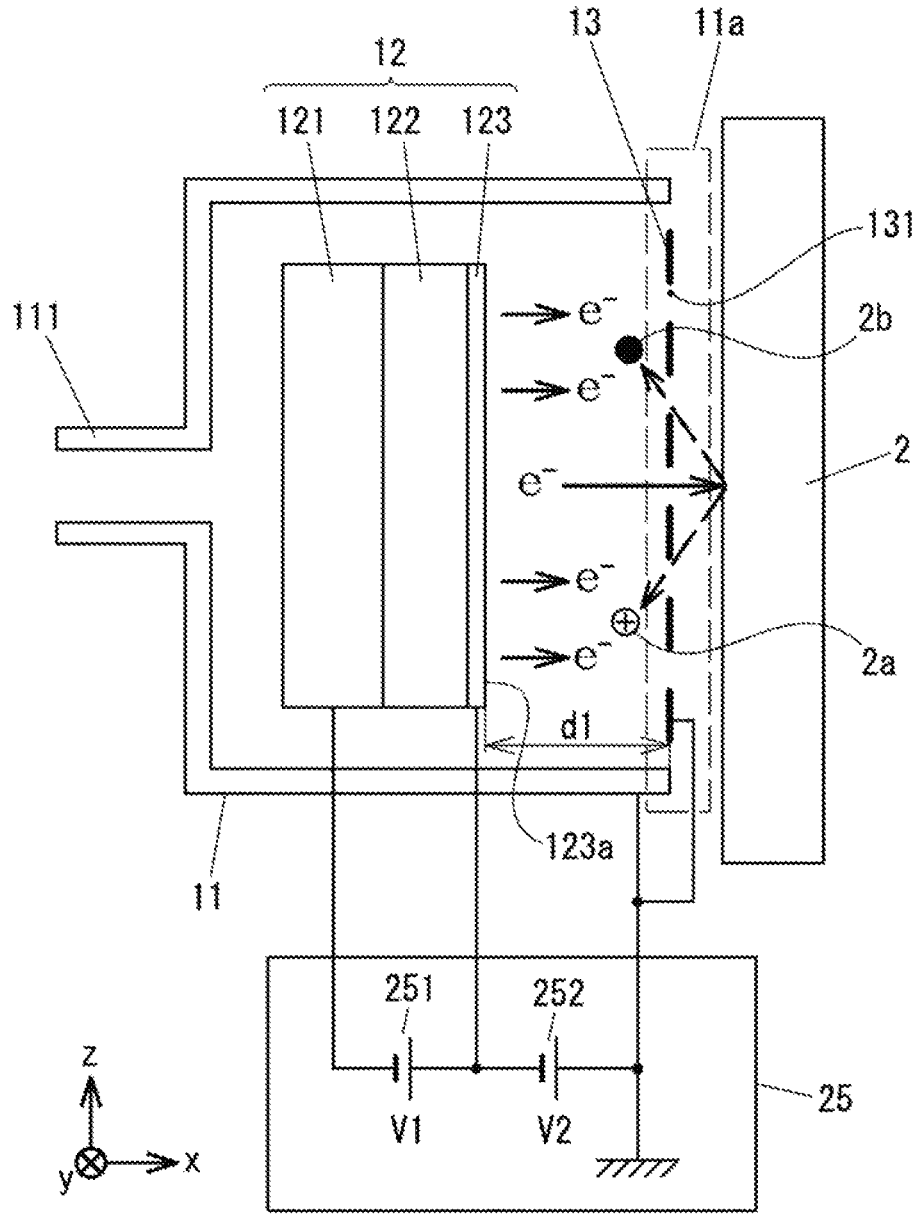
FIG. 3 is a view explaining a sampling probe.

FIG. 3 is a view explaining a sampling probe 10. A casing 11 houses a surface emission type electron source 12, and an opening 11*a* of the casing 11 is provided with a counter electrode 13. As the electron source 12, for example, an electron emission element described in the Japanese Patent No. 6016475 is used. The electron emission element described in the Japanese Patent No. 6016475 is a surface emission type electron emission element that emits electrons accelerated inside the electron emission element from the emission surface. The case in which this electron emission element is used as the electron source 12 is described below as an example.

The electron emission element used in the electron source 12 is a plate-like element including a substrate electrode 121, an electron acceleration layer 122, and an emission surface side electrode 123. The substrate electrode 121 is an electrode layer containing a conductive substance such as metal and is composed of, for example, a stainless steel substrate. The electron acceleration layer 122 is a layer in which a conductive material is dispersed in an insulating material. The thickness of the electron acceleration layer 122 can be adjusted appropriately in accordance with a voltage to be applied to between the substrate electrode 121 and the emission surface side electrode 123 or the resistance of the electron acceleration layer 122. The resistance of the electron acceleration layer 122 can be adjusted by changing the proportion of a conductive material in the insulating material and the like.

In an example of the electron acceleration layer 122: as the insulating material, among silicon compounds, a silicone resin obtained by condensation polymerization of a compound where a hydroxy group is bonded directly to silicon (R3Si—OH) (where Si represents silicon) is used; and as the conductive material, fine particles of a metal such as gold, silver, platinum, or palladium are used. The average diameter of the metal fine particles can be 5 nm to 10 nm or the like. The thickness of the electron acceleration layer can be 0.3 to 2.0 μm or the like.

The emission surface side electrode 123 is an electrode layer containing a conductive substance. However, the material thereof is not particularly limited as long as a voltage for accelerating electrons can be applied. In order to cause electrons to efficiently transmit therethrough, the emission surface side electrode 123 is preferably thinner under the condition where the voltage can be applied. The thickness of the emission surface side electrode 123 can be, for example, several tens of nanometers or the like.

A voltage V1 is applied between the substrate electrode 121 and the emission surface side electrode 123 by a first power supply 251 provided in the power supply unit 25. Accordingly, electrons ($e^-$) are emitted from the electron emission surface of the emission surface side electrode 123. The voltage V1 is selected as appropriate and is set to, for example, several tens of volts.

The counter electrode 13 provided at an opening 11*a* is an accelerating electrode for accelerating electrons emitted from the electron emission surface 123*a* toward the opening. The counter electrode 13 is constituted so as to hold at ground potential, and the emission surface side electrode 123 is set at negative potential (−V2) by a second power supply 252 provided in the power supply unit 25. The voltage V2 of the second power supply 252 is set to a voltage required for obtaining a sample by electrons, as appropriate. The casing 11 is formed of a conductive material (for example, a metal material) and is grounded for safety.

A plurality of openings 131 are formed to the counter electrode 13, and electrons emitted from the electron emission surface 123*a* pass through the openings 131 and collide with the surface of the specimen 2. Accordingly, molecules and atoms constituting the specimen 2 are ionized, and molecules and atoms in neutral state are detached from the surface by an electron impact desorption.

The distance dl from the electron emission surface 123*a* of the electron source 12 to end of the opening of the casing 11 is preferably as small as possible in order to prevent attenuation of an electron beam caused by a collision between electrons and air and is set to, for example, about several millimeters to about 10 mm. It is preferred that the opening end of the casing 11 contacts the surface of a measurement target while measurement.

Positively charged ions 2*a* generated by irradiation of the specimen 2 with electrons are accelerated toward the electron source 12 by the voltage V2. As illustrated in FIG. 1, the outlet 111 of the casing 11 is connected via a tube 14 to a vacuum chamber 23 in a vacuum state. Therefore, an outside air flows into the casing 11 from a clearance between the casing 11 and the specimen 2, and thereby an air flow from the opening 11*a* to the outlet 111 is formed. A part of the ions 2*a* and the detached neutral particles 2*b* generated by electron irradiation move toward the outlet 111 by the acceleration by the voltage V2 and the air flow and flow into the vacuum chamber 23 of the measurement unit 20 via the tube 14.

As mentioned above, the electron source 12 provided in the sampling probe 10 is constituted with a surface emission type electron emission element capable of emitting electrons under atmospheric pressure. Thus, the specimen 2 disposed in the atmosphere can be irradiated with electrons from the opening 11*a* of the casing 11. Therefore, direct sampling by the sampling probe 10 from the specimen 2 disposed in the atmosphere can be performed. Further, the electron source 12 constituted with an electron emission element can have a rectangular shape of several centimeters×several centimeters. Thus, the sampling probe 10 can be reduced in size to such a degree that it can be handled with one hand. That is, the specimen 2 disposed in the atmosphere can be analyzed by a simple operation. The shape of the electron emission element is not limited to a rectangular shape illustrated and can be, for example, a circular shape or the like.

Variation 1

In the above-mentioned embodiment, a counter electrode 13 for acceleration is provided in an opening 11*a* of the casing 11. The counter electrode 13 may not be provided in the case in which the specimen 2 is formed of a conductive substance. In this case, the surface of the specimen 2 is held at ground potential. Thus, electrons emitted from an electron emission surface 123*a* of an electron source 12 are accelerated by a voltage V2 between the electron emission surface 123*a* and the surface of the specimen.

Variation 2

Figure 4:
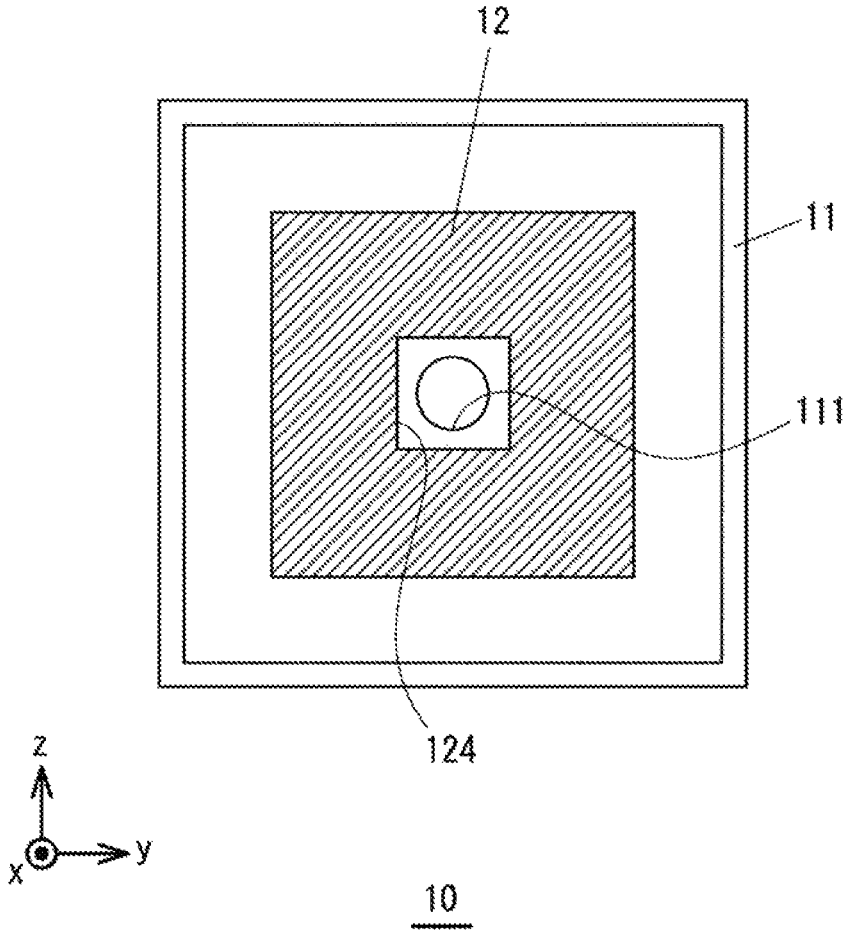
FIG. 4 is a view illustrating an example of the shape of an electron source.
Figure 5:
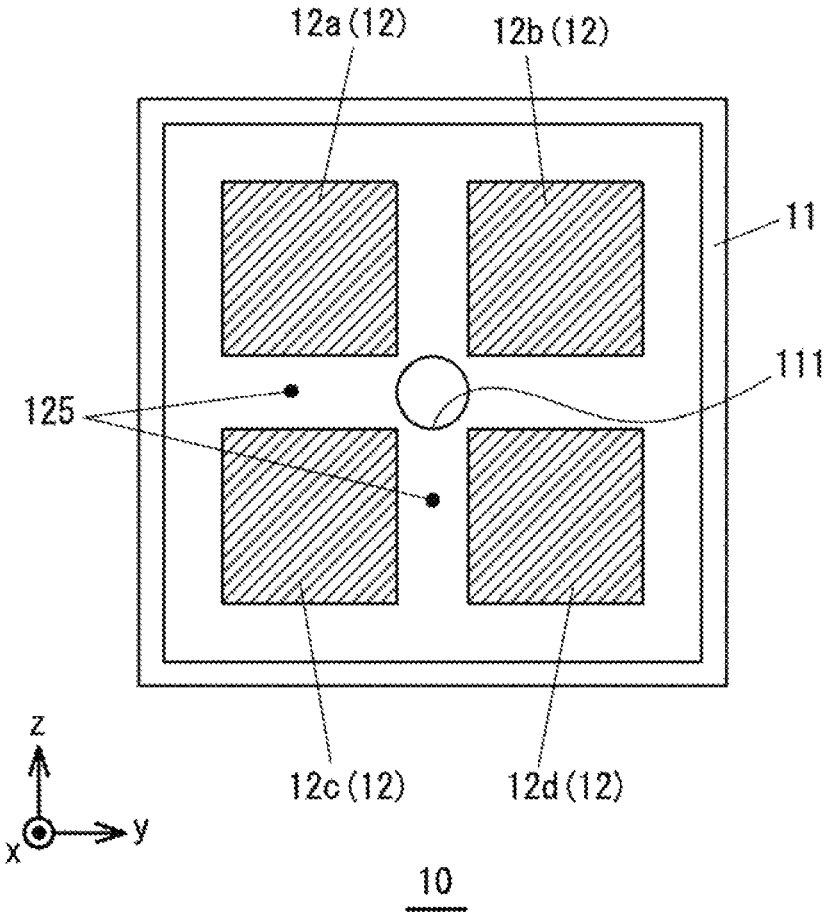
FIG. 5 is a view illustrating another example of the shape of an electron source.

FIGS. 4 and 5 are views explaining a Variation 2 and illustrating a sampling probe 10 viewed from the side of a specimen 2. In an example shown in FIG. 4, a through hole 124 is formed at a central region of the electron source 12. The through hole 124 is formed at a position opposed to an outlet 111, and the outlet 111 can be seen from the opening 11*a* through the through hole 124. In an example shown in FIG. 5, the electron source 12 is configured as a plurality of electron emission elements 12*a* to 12*d*, and the electron emission elements 12*a* to 12*d* are disposed being separated to each other at clearances 125. The outlet 111 can be seen from the side of the opening 11*a* through the clearances 125 between the electron emission elements 12*a* to 12*d*.

As described above, in the Variation 2, the electron source 12 is provided with a through hole 124 as illustrated in FIG. 4, or a plurality of electron emission elements 12*a* are disposed being separated to each other at clearances 125 as illustrated in FIG. 5, to form a penetration passage penetrating from the opening side to the outlet side of the electron source 12. Accordingly, more ions 2*a* and detached neutral particles 2*b* generated can be introduced to the outlet 111, thereby, allowing the detection sensitivity of the mass spectrometer 1 to improve.

Variation 3

Figure 6:
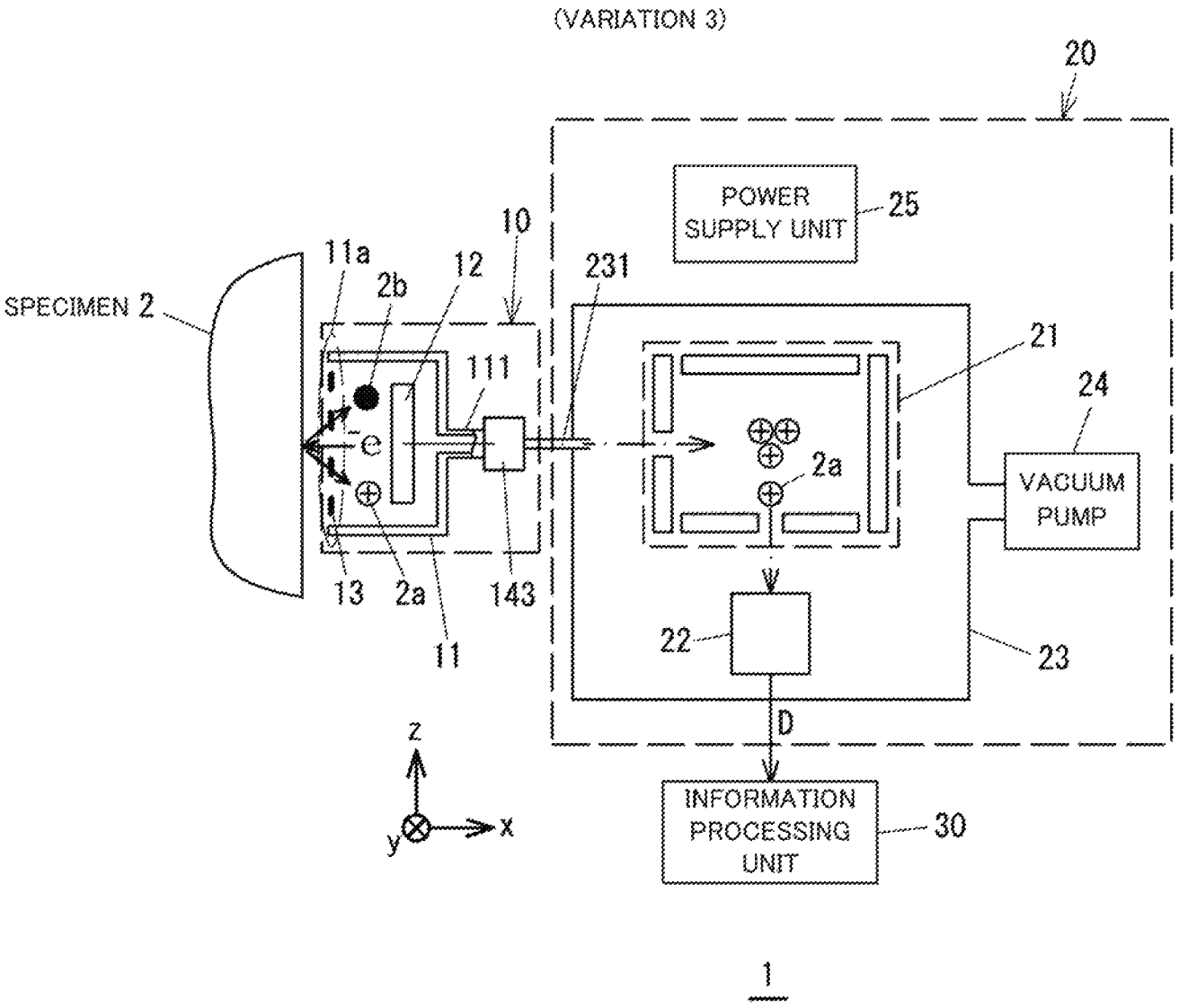
FIG. 6 is a view illustrating a Variation 3.

FIG. 6 is a view illustrating a Variation 3. In the Variation 3, an outlet 111 provided to a casing 11 of a sampling probe 10 and an inlet 231 provided to a vacuum chamber 23 of a measurement unit 20 are detachably connected to each other using a coupling 143. By connecting the sampling probe 10 and the measurement unit 20 to each other without a tube 14 in this manner, it can be reduced that obtained ions are neutralized during transfer from the sampling probe 10 to the measurement unit 20.

Further, by the detachable connection using the coupling 143, handling becomes easy as in the case of using couplings 141 and 142. Although, in the configuration illustrated in FIG. 6, the sampling probe 10 is detachably connected to the vacuum chamber 23 using the coupling 143, the outlet 111 and the inlet 231 can be directly connected to each other without the coupling 143.

Variation 4

Figure 7:
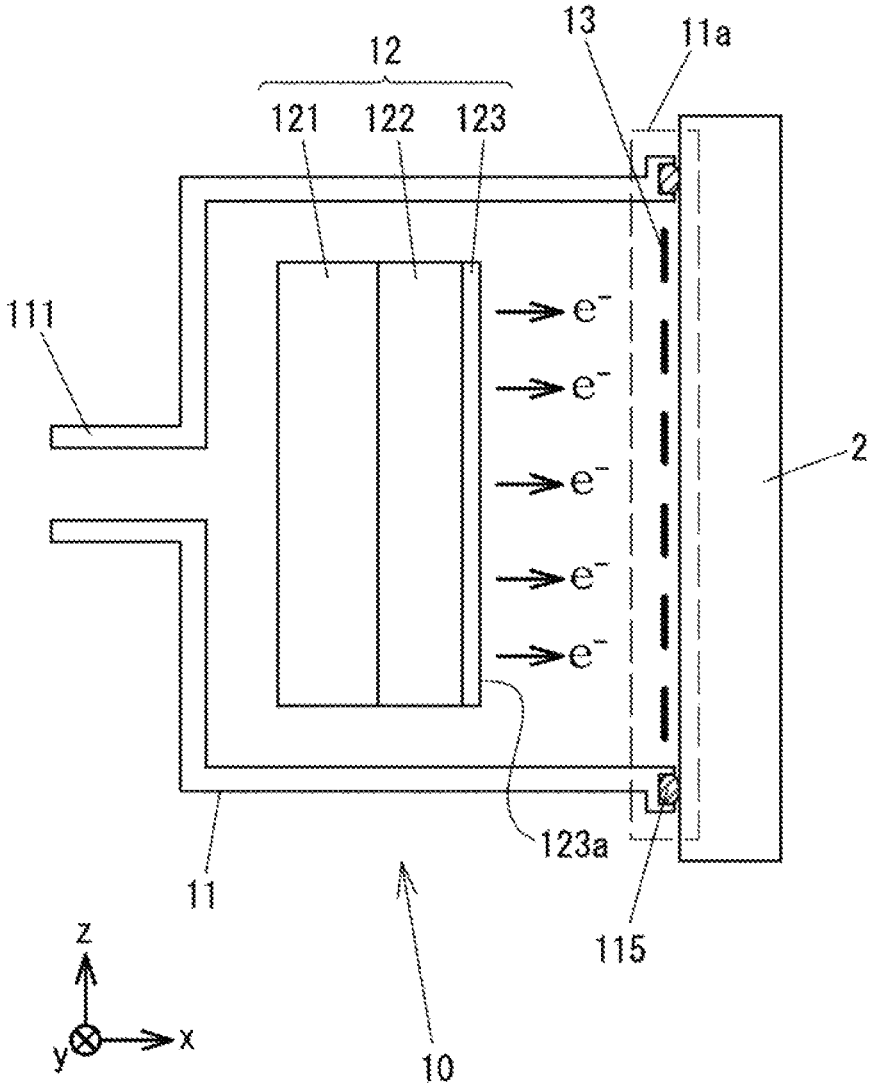
FIG. 7 is a view illustrating a Variation 4.

FIG. 7 is a view illustrating a Variation 4. In the Variation 4, a sealing member 115 is provided at an opening 11*a* of a casing 11 in a sampling probe 10. As the sealing member 115, an O-ring for use in vacuum is used, for example. During a sampling from a specimen 2, the end of the casing 11 is pressed against the surface of the specimen 2 to seal a clearance between the casing 11 and the specimen 2 by the sealing member 115. This results in prevention of air flown into the inside of the casing, and the casing is under negative pressure compared with atmospheric pressure.

The pressure in the casing during a measurement depends on the conductance from the casing 11 to the vacuum chamber 23 or lapse time from pressing the casing 11 against the specimen 2 to the measurement. However, by holding the pressure in the casing under negative pressure compared with atmospheric pressure, attenuation of emitted electrons can be prevented. Thereby, allowing the detection sensitivity of the mass spectrometer to improve.

Mass Spectrometry

Figure 8:
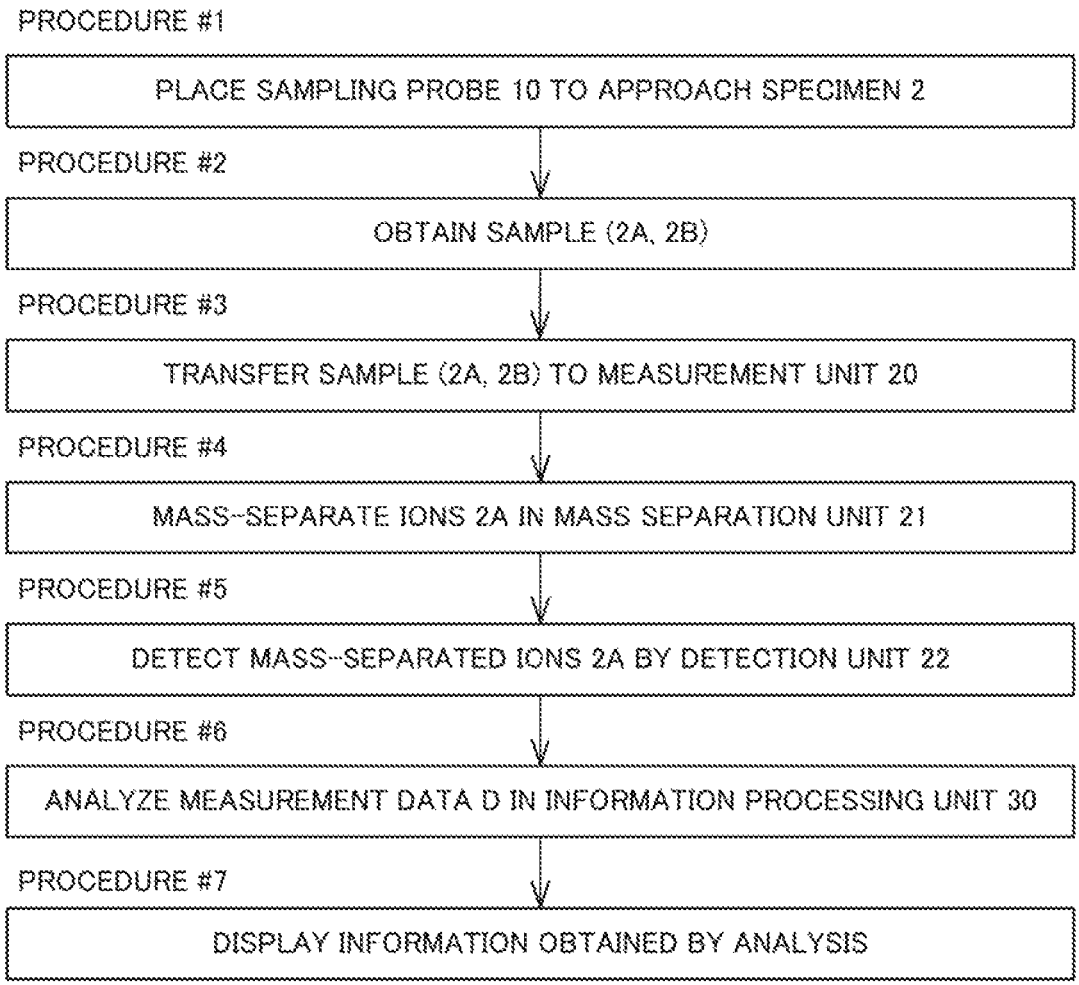
FIG. 8 is a view explaining an analysis procedure using a mass spectrometer.

FIG. 8 is a view explaining an analysis procedure of a specimen 2 using a mass spectrometer 1. In procedure #1, an opening 11*a* of a sampling probe 10 is approached or contacted the surface of a specimen 2, disposed in the atmosphere, and the specimen 2 is irradiated with electrons emitted from an electron source 12 of the sampling probe 10. In procedure #2, samples (ions 2*a* and detached neutral particles 2*b*) generated by interaction of irradiation electrons and the surface of the specimen 2 are obtained by the sampling probe 10. In procedure #3, the ions 2*a* and the detached neutral particles 2*b* are transferred from the sampling probe 10 to a measurement unit 20.

In procedure #4, the ions 2*a* transferred to the measurement unit 20 are mass-separated by a mass separation unit 21. In procedure #5, the ions 2*a* having been mass-separated by the mass separation unit 21 are detected by a detection unit 22. In procedure #6, measurement data D obtained by the detection of the ions 2*a* is analyzed by an information processing unit 30. In procedure #7, the information processing unit 30 displays information obtained by the analysis of the measurement data D on a display (not shown).

Second Embodiment

Figure 9:
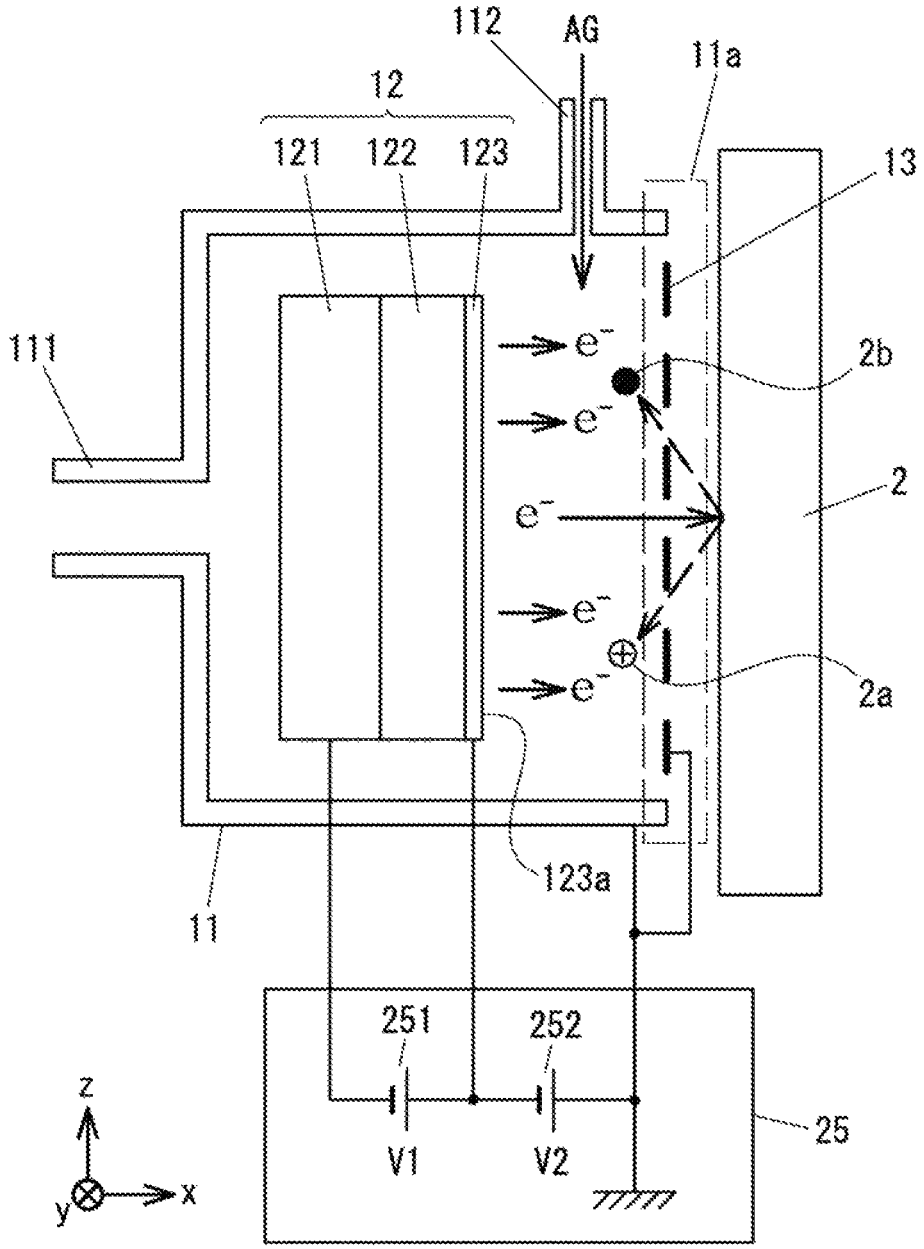
FIG. 9 is a view explaining the second embodiment.

FIG. 9 is a view explaining the second embodiment and also a schematic view of a sampling probe 10 and a power supply unit 25. In the second embodiment, an assist gas inlet 112 for introducing assist gas AG for ionization is formed to a casing 11 of a sampling probe 10. The assist gas inlet 112 is formed at the side surface of the casing 11, and formed position thereof is between an electron emission surface 123*a* of an electron source 12 and an opening 11*a*. As the assist gas for ionization, assist gas (such as ammonia, methane, and isobutane) used for chemical ionization, assist gas (such as helium) for penning ionization, or the like is used.

Upon colliding of electrons emitted from the electron source 12 and the assist gas AG introduced from the assist gas inlet 112, an activated gas species of the assist gas AG is generated. In the case the assist gas is for chemical ionization, ionization occurs by collision of electrons, and in the case the assist gas is for Penning ionization, metastable particles (an excited species) of the assist gas are generated by collision of electrons. The generated activated gas species interacts with the surface of the specimen 2, thereby ions 2*a* and desorbed neutral particles 2*b* are generated. The ions 2*a* and the neutral particles 2*b* are also generated by interaction of the electrons and the surface of the specimen 2 as a matter of course. A part of the ions 2*a* and the neutral particles 2*b* move to the outlet 111 and flow into a vacuum chamber 23 of a measurement unit 20 via a tube 14.

A sample (ions 2*a* and detached neutral particles 2*b*) can be generated more effectively by using assist gas AG in this manner, compared with the case not using the assist gas AG Thereby, allowing the detection sensitivity of the mass spectrometer 1 to improve.

Variation 5

Figure 10:
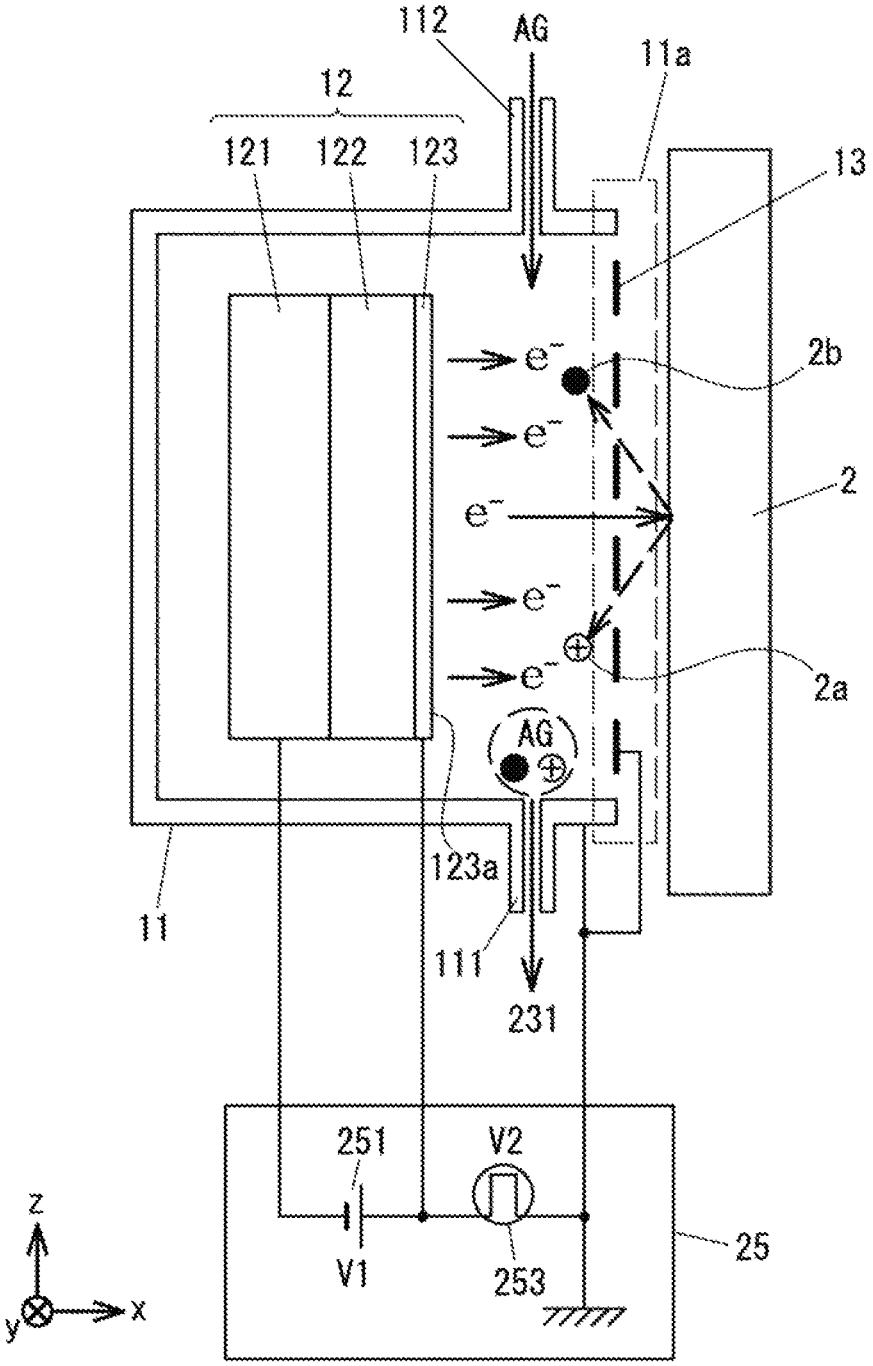
FIG. 10 is a view illustrating a Variation 5 which is a variation of the second embodiment.

FIG. 10 is a view illustrating a Variation 5 which is a variation of the second embodiment. In the configuration illustrated in FIG. 9 described above, an outlet 111 is provided on the back surface side of an electron source 2, i.e., a side opposed to a substrate electrode 121. Thus, the proportion of the ions 2*a* reaching the outlet 111 tends to decrease.

In the configuration illustrated in FIG. 10, an outlet 111 is disposed to be opposed to an assist gas inlet 112, and a second power supply 252 provided in a power supply unit 25 of FIG. 9 is replaced with a third power supply 253 which applies a pulsed (for example, rectangular pulse) voltage V3. Assist gas AG is introduced from the assist gas inlet 112 to a region between the electron source 12 and the counter electrode 13 in a direction intersects with the direction for emission of electrons emitted from the electron source 12.

The third power supply 253 alternately switches the voltage V3 between the on state of V3=V2 and the off state of V3=0. In the state of V3=V2, in the same manner as in the case of the configuration illustrated in FIG. 9, electrons emitted from the electron emission surface 123*a* of the electron source 12 are accelerated toward the specimen 2 by an electric field between the emission surface side electrode 123 and the counter electrode 13, and a part of the electrons collide with assist gas AG thereby generating an activated gas species. Then, the emitted electrons and the generated activated gas species interact with the surface of the specimen 2, thereby generating ions 2*a* and detached neutral particles 2*b*.

When the third power supply 253 switches the state of the voltage from V3=V2 to V3=0, a force of the ions 2*a* caused by an accelerating voltage toward the electron emission surface 123*a* becomes zero. Accordingly, the generated ions 2*a* and detached neutral particles 2*b* are directed toward the outlet 111 by a flow of the assist gas AG introduced from the assist gas inlet 112 in the negative direction of z axis and then transferred from the outlet 111 to the inlet 231 of the vacuum chamber 23 provided to the measurement unit 20 along with the gas flow.

In the configuration illustrated in FIG. 10, the assist gas inlet 112 is disposed to be opposed to the outlet 111, and there is no shield of blocking the flow of the assist gas AG therebetween. In the state of V3=0, an accelerating force for ions 2*a* toward the electron source 2 becomes zero. Thus, the ions 2*a* emitted from the surface of the specimen 2 can be efficiently directed toward the outlet 111. Thereby, allows the detection sensitivity of the mass spectrometer 1 to improve.

Variation 6

Figure 11:
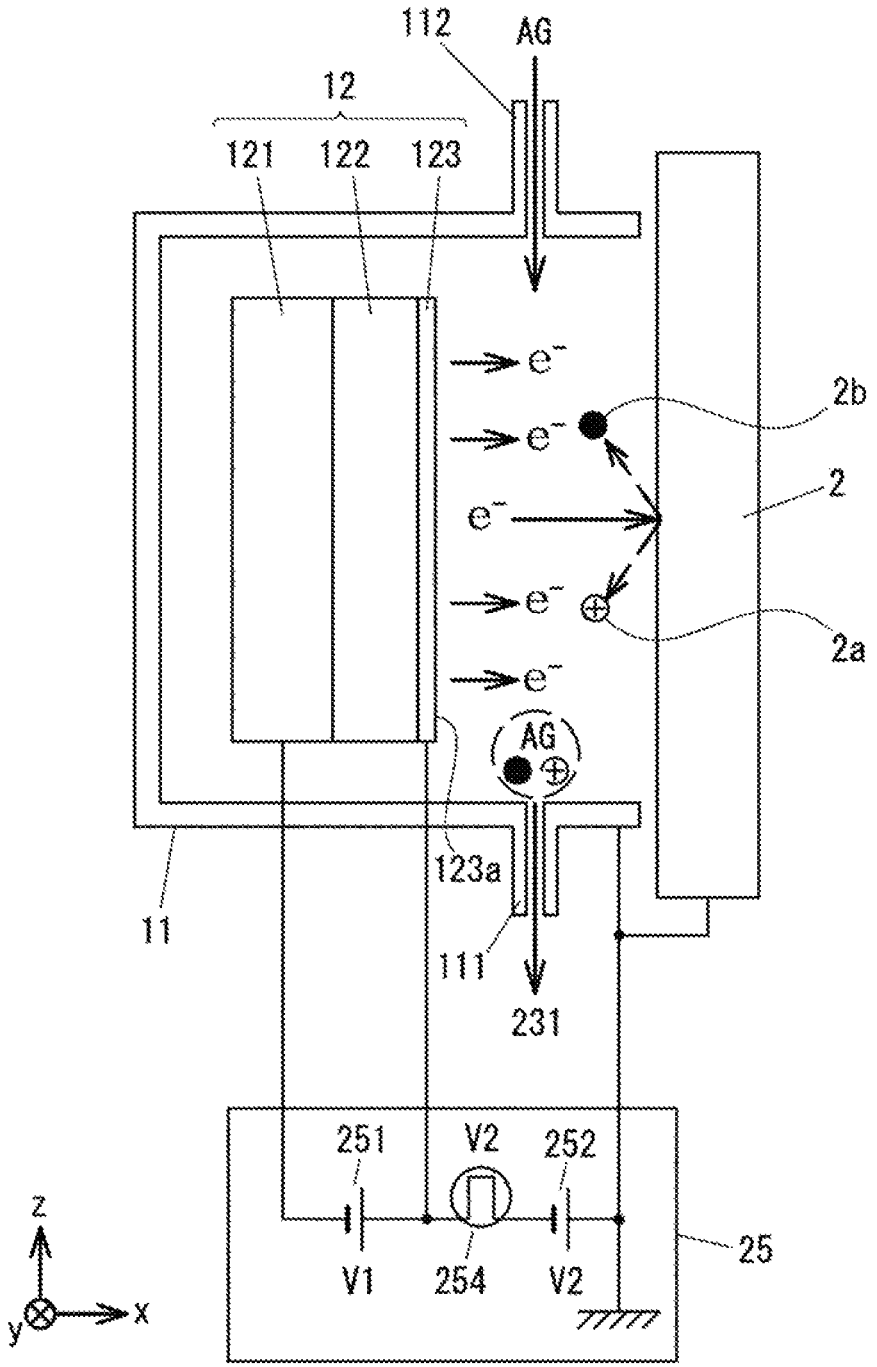
FIG. 11 is a view illustrating a Variation 6.

FIG. 11 is a view illustrating a Variation 6, and in FIG. 11, a counter electrode 13 is omitted from the configuration illustrated in FIG. 10, and the configuration of a power supply unit 25 is changed in response to the omission of the counter electrode 13. The power supply unit 25 is provided with a fourth power supply 254 which applies a rectangular voltage V2, in addition to the first power supply 251 and the second power supply 252. The fourth power supply 254 alternately switches the voltage V2 between the on state and the off state where the voltage V2 is zero. A casing 11 and a specimen 2 are held at ground potential.

A voltage V1 is applied to an electron source 12, and electrons are emitted from an electron emission surface 123*a*. In condition where a voltage of the fourth power supply 254 is zero, an electric potential of the emission surface side electrode 123 becomes −V2. Thus, electrons emitted from the electron emission surface 123*a* receive a force toward the specimen 2 by an electric field and accelerated toward the specimen 2. Then, ions 2*a* and detached neutral particles 2*b* are emitted from the surface of the specimen 2 by interaction of the accelerated electrons and the surface of the specimen 2. A force toward the electron source 2 is applied to emitted positive ions 2*a* from an electric field, and the ions 2*a* are accelerated toward the electron source 2.

When the fourth power supply 254 switches the state of the voltage from zero to V2, an electric potential of the emission surface side electrode 123 becomes identical to the ground potential, and a force having been applied to the ions 2*a* by an electric field becomes zero. Accordingly, the generated ions 2*a* and detached neutral particles 2*b* are drifted toward the outlet 111 by a flow of the assist gas AG introduced from the assist gas inlet 112 in the negative direction of z axis and then transferred through the outlet 111 to the inlet 231 of the vacuum chamber 23 provided in the measurement unit 20 along with the gas flow. The Variation 6 also allows the detection sensitivity of the mass spectrometer to improve by obtaining a sample using assist gas AG.

Third Embodiment

Figure 12:
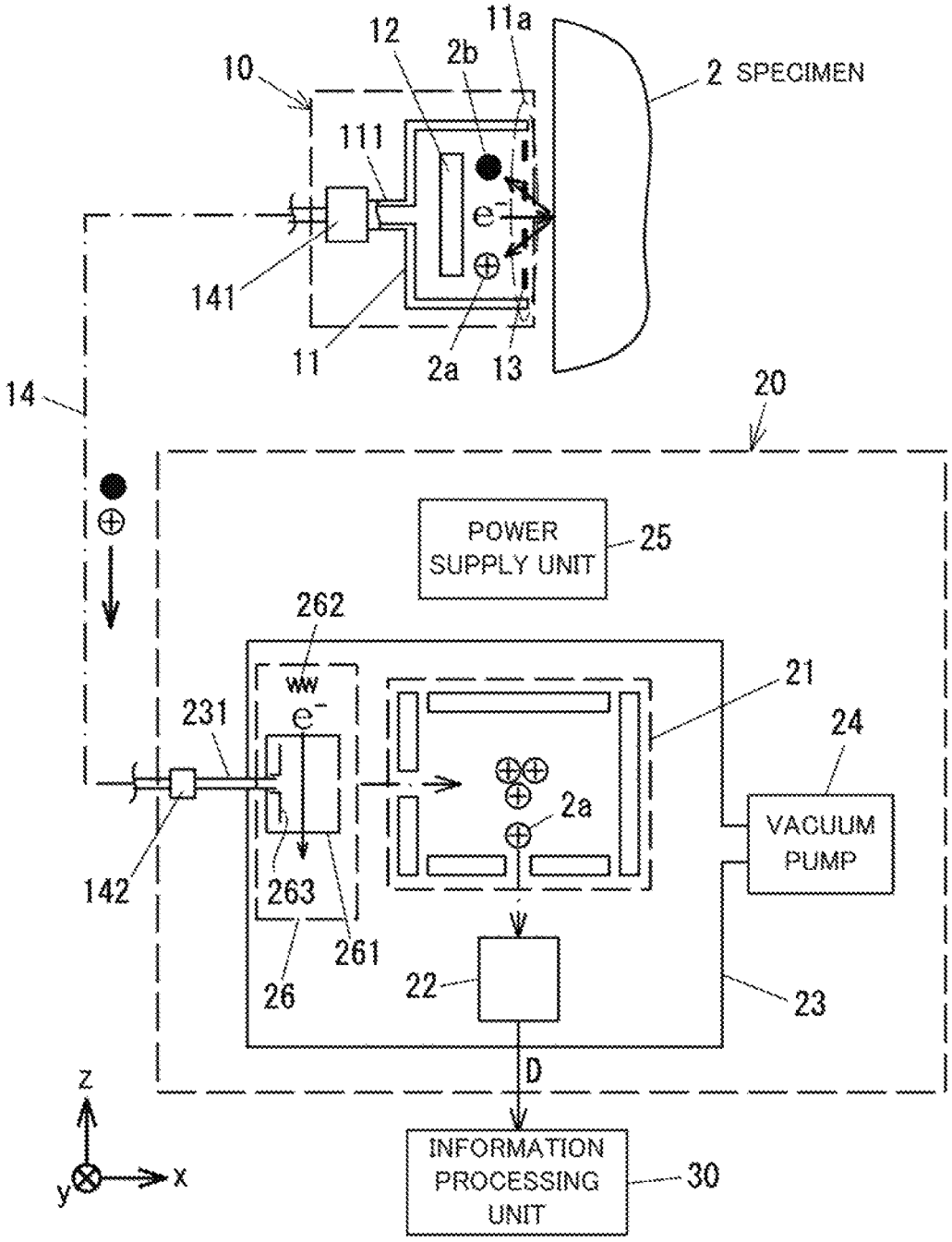
FIG. 12 is a view explaining the third embodiment.

FIG. 12 is a view explaining the third embodiment and also a schematic view illustrating an entire configuration of a mass spectrometer 1. In the third embodiment, a measurement unit 20 is further provided with an ionization unit 26 that ionizes detached neutral particles 2*b* obtained by a sampling probe 10. The ionization unit 26 includes an ionization chamber 261, a filament 262, and a pushing electrode 263. Ions 2*a* introduced from an inlet 231 into a vacuum chamber 23 and then passed through the ionization unit 26 are once trapped in a mass separation unit 21.

On the other hand, detached neutral particles 2*b* and gas molecules (molecules of air and assist gas) introduced from the inlet 231 into the vacuum chamber 23 are ionized by electrons emitted from the filament 262 which was heated. The detached neutral particles 2*b* are ionized and become to ions 2*a*. Generated positive ions 2*a* are pushed out from the ionization chamber 261 by the pushing electrode 263 to which a positive voltage has been applied and then once trapped in the mass separation unit 21. Ions 2*a* mass-separated by the mass separation unit 21 are detected by a detection unit 22. In the third embodiment, not only ions 2*a* emitted from the specimen 2, but also detached neutral particles 2*b* are ionized and detected in this manner. This allows the detection sensitivity of the mass spectrometer to improve.

As mentioned above, a part of ions obtained by the sampling probe 10 are neutralized during transfer from the sampling probe 10 to the mass separation unit 21, thereby reducing ions 2*a* reaching the mass separation unit 21. However, in the configuration illustrated in FIG. 12, neutralized particles obtained by neutralizing ions 2*a* are again ionized by the ionization unit 26. This allows the reduction in detection sensitivity due to the neutralization of ions 2*a* to be prevented. The third embodiment may have a configuration of introducing assist gas AG into a casing 11 as in the second embodiment.

Figure 13:
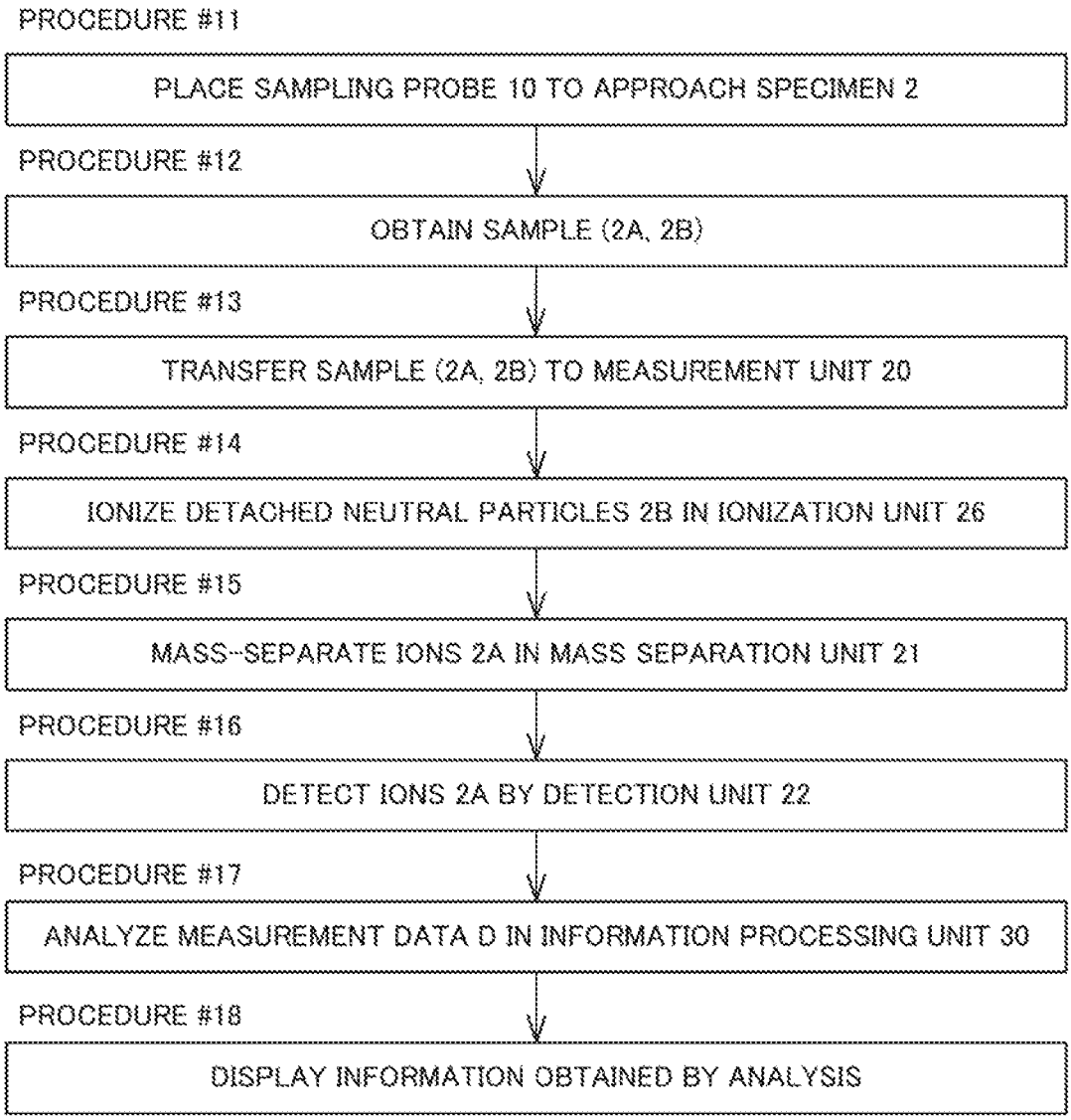
FIG. 13 is a view explaining an analysis procedure in the third embodiment.

FIG. 13 is a view explaining an analysis procedure in the third embodiment. In procedure #11, an opening 11*a* of a sampling probe 10 is approached or contacted the surface of a specimen 2 disposed in the atmosphere, and the specimen 2 is irradiated with electrons emitted from an electron source 12 of the sampling probe 10. In procedure #12, a sample (ions 2*a* and detached neutral particles 2*b*) generated by interaction of the electrons with which the specimen 2 is irradiated and the surface of the specimen 2 are obtained by the sampling probe 10. In procedure #13, the ions 2*a* and the detached neutral particles 2*b* are transferred from the sampling probe 10 to a measurement unit 20. The procedures #11 to #13 described above are the same as the procedures #1 to #3.

In procedure #14, the detached neutral particles 2*b* transferred to the measurement unit 20 are ionized by an ionization unit 26. In procedure #15, the ions 2*a* transferred to the measurement unit 20 and the ions 2*a* generated by ionization using the ionization unit 26 are mass-separated by a mass separation unit 21. In procedure #16, the ions 2*a* having been mass-separated by the mass separation unit 21 are detected by a detection unit 22. In procedure #17, measurement data D obtained by the detection of the ions 2*a* is analyzed by an information processing unit 30. In procedure #18, the information processing unit 30 displays information obtained by the analysis of the measurement data D on a display (not shown).

It will be understood by a person skilled in the art that the above-mentioned plural exemplary embodiments and variations thereof are specific examples of the following aspects.

[1] A mass spectrometer according to one aspect includes: a sampling probe that irradiates a specimen disposed in the atmosphere with an electron and obtains a sample separated from the specimen; and a measurement unit that performs mass spectrometry of the sample obtained by the sampling probe, wherein the sampling probe includes: a casing having an opening which is opened to the atmosphere and an outlet through which the sample is discharged to the measurement unit; and a surface emission type electron emission element housed in the casing such that an electron emission surface thereof opposes to the opening.

The surface emission type electron emission element can emit electrons in the atmosphere. Therefore, a sample can be obtained by irradiating the specimen disposed in the atmosphere with electrons. Further, the sampling probe can be small by using the electron emission element, and a portable, small mass spectrometer can be achieved.

[2] The mass spectrometer according to the item [1] above, further includes an electrode that accelerates electrons emitted from the electron emission element toward the opening. By providing the electrode, the specimen 2 can be irradiated with electrons with larger energy. It is to be noted that a voltage-variable power supply may be used as the second power supply 252 that applies a voltage to the counter electrode 13 to adjust a voltage to be applied depending on the specimen 2.

[3] The mass spectrometer according to the item [1] or [2] above, it may have a configuration wherein the outlet and the opening are disposed to be opposed to each other with respect to the electron emission element, and a penetration passage penetrating from a surface opposed to the opening to a surface opposed to the outlet is formed to the electron emission element disposed between the opening and the outlet.

For example, as illustrated in FIGS. 4 and 5, by providing the electron source 12 disposed between the outlet 111 and the opening 11*a* with a through hole 124 or a clearance 125 as a penetration passage, more ions 2*a* and detached neutral particles 2*b* generated can be introduced to the outlet 111. This allows the detection sensitivity of the mass spectrometer 1 to improve.

[4] The mass spectrometer according to any one of the items [1] to [3] above, wherein the casing includes an assist gas inlet through which assist gas for ionization is introduced to the casing. Samples (ions 2*a* and detached neutral particles 2*b*) can be generated more effectively by using assist gas AG in this manner, compared with the case of using no assist gas AG This allows the detection sensitivity of the mass spectrometer 1 to improve.

[5] The mass spectrometer according to the item [4] which cites the item [2] above or the mass spectrometer according to the item [4] which cites the item [3] which cites the item [2] above, further comprises a pulse voltage source that alternately sets an electric potential of the electron emission surface between a first electric potential that is lower than that the electric potential of the electrode or the specimen and a second electric potential that is higher than the first electric potential and is equal to or lower than the electric potential of the electrode or the specimen, and wherein the assist gas inlet is provided so that the assist gas is introduced in a direction which intersects the direction of emission of electrons emitted from the electron emission element, and the outlet is disposed so as to oppose to the assist gas inlet.

For example, in the configuration illustrated in FIG. 10 or 11, the assist gas inlet 112 is disposed so as to oppose to the outlet 111, and there is no shield of blocking the flow of the assist gas AG therebetween. This allows a sample to be efficiently discharged via the outlet 111 by effective use of the flow of the assist gas AG That is, sampling efficiency can be high compared with the case of disposing the outlet 111 on the back surface side of the electron source 12 as illustrated in FIG. 9.

Further, a third power supply 253 is provided in the configuration illustrated in FIG. 10, and a second power supply 252 and a fourth power supply 254 are provided in the configuration illustrated in FIG. 11. Thus, the electric potential of the electron emission surface 123*a* is set so as to alternately switch between zero volts and V2 volts, and thereby generated ions 2*a* are prevented from being pulled toward the electron source 12. This allows sampling efficiency of the ions 2*a* to be further improved.

In the configuration illustrated in FIG. 11, the fourth power supply 254 generates a V2 pulse volts to set the electric potential of the electron emission surface 123*a* so as to alternately switch between zero volts and V2 volts. However, the voltage of the fourth power supply 254 may be set to satisfy the condition of V3<V2. In this case, the electric potential of the electron emission surface 123*a* alternately switch between (V2−V3) volts and V2 volts. Since (V2−V3)>0, an effect of reducing the ions 2*a* being pulled toward the electron source 12 is smaller than the case described above.

[6] The mass spectrometer according to any one of the items [1] to [5] above, wherein the outlet is connected to the measurement unit in direct or via a sample transfer tube. The sampling probe 10 may be connected to the measurement unit 20 via the tube 14 for transferring a sample as in the configuration of FIG. 1 or may be connected directly to the measurement unit 20 as illustrated in FIG. 6. As illustrated in FIG. 6, with the configuration of the direct connection, the transfer passage from the sampling probe 10 to the measurement unit 20 can be as short as possible. Thus, an effect of preventing neutralization of ions 2*a* is high.

[7] The mass spectrometer according to the item [6] above, wherein the measurement unit includes a connecting unit that can detachably attach to the outlet or the sample transfer tube. With the configuration of detachably connecting a tube 14 via couplings 141 and 142 as illustrated in FIG. 1 or the configuration of detachably connecting an outlet 111 to an inlet 231 via a coupling 143 as illustrated in FIG. 6, the sampling probe 10 can be easily attached to and detached from the measurement unit 20.

[8] The mass spectrometer according to any one of the items [1] to [7] above, wherein a sealing member for sealing a clearance between the casing and the specimen is provided at the opening of the casing. For example, by providing a sealing member 115 on the end surface of the casing 11 on the opening side as illustrated in FIG. 7, a clearance between the opening 11*a* and the surface of a specimen 2 can be sealed with the sealing member 115 when the opening 11*a* contacts the surface of the specimen 2. Accordingly, the pressure in the casing becomes negative pressure compared with atmospheric pressure, and it can prevent from attenuation of the electrons due to the collision between the electrons emitted from the electron source 12 and air molecules.

[9] A sampling probe according to one aspect includes: a casing having an opening that is opened to the atmosphere and an outlet through which a sample that has been obtained is discharged; and a surface emission type electron emission element housed in the casing such that an electron emission surface thereof opposes to the opening. When the opening is disposed so as to oppose the specimen, the specimen is irradiated with electrons emitted from the electron emission element, and a sample is detached from the specimen. Because the surface emission type electron emission element can emit electrons in the atmosphere, it is possible to provide a sampling probe that can perform a sampling from a specimen disposed in the atmosphere.

[10] An analysis method according to one aspect, includes: placing a probe having an electron source so as to oppose to a specimen that is disposed in the atmosphere; irradiating the specimen with an electron emitted from the electron source; introducing a sample detached from the specimen to an analyzer; and analyzing the introduced sample. This allows analysis of the specimen disposed in the atmosphere to be analyzed easily.

Although various embodiments and variations thereof are described above, the present invention is not limited thereto. Other aspects conceivable within the scope of the technical idea of the present invention are encompassed in the scope of the present invention. For example, the surface emission type electron emission element is not limited to the embodiments, as long as it can emit electrons under atmospheric pressure. In the above-described embodiments, plate-like electrodes are used as the electrodes 211 to 216 of an ion trap type mass separation unit 21, but the inner surface of each electrode may have a hyperboloid shape. The case of using the electrodes each having a hyperboloid-shaped inner surface has an advantage of a high mass separation performance although the manufacturing costs increase. On the other hand, in the case of using the plate-like electrodes, the mass spectrometer can be manufactured at lower cost although the mass separation performance is inferior in comparison with the case to use the hyperboloid electrodes. Portable small mass spectrometers are desired to be lower cost rather than having a high mass separation performance. Therefore, it can be said that plate-like electrodes such as the electrodes 211 to 216 are more desirable.

REFERENCE SIGNS LIST

1: mass spectrometer, 2: specimen, 2*a*: ion, 2*b*: detached neutral particle, 10: sampling probe, 11: casing, 11*a*: opening, 12: electron source, 13: counter electrode, 14: sample transfer tube, 20: measurement unit, 21: mass separation unit, 22: detection unit, 23: vacuum chamber, 24: vacuum pump, 25: power supply, 26: ionization unit, 30: information processing unit, 111: outlet, 112: assist gas inlet, 115: sealing member, 123*a*: electron emission surface, 124: through hole, 125: clearance, 141, 142, 143: coupling, 231: inlet, 253: third power supply, AG: assist gas

The invention claimed is:

1. A mass spectrometer, comprising:

a sampling probe that irradiates a specimen disposed in the atmosphere with an electron and obtains a sample desorbed from the specimen; and a measurement unit that performs mass spectrometry of the sample obtained by the sampling probe, wherein the sampling probe comprises:

a casing having an opening which is opened to the atmosphere and an outlet through which the sample is discharged to the measurement unit; and a surface emission type electron emission element housed in the casing such that an electron emission surface thereof opposes to the opening.

2. The mass spectrometer according to claim 1, further comprising:

an electrode that accelerates electrons emitted from the electron emission element toward the opening.

3. The mass spectrometer according to claim 1, wherein:

the outlet and the opening are disposed to be opposed to each other with respect to the electron emission element; and a penetration passage penetrating from a surface opposed to the opening to a surface opposed to the outlet is formed to the electron emission element disposed between the opening and the outlet.

4. The mass spectrometer according to claim 1, wherein the casing includes an assist gas inlet through which assist gas for ionization is introduced to the casing.

5. The mass spectrometer according to claim 4, further comprising:

an electrode that accelerates electrons emitted from the electron emission element toward the opening; and a pulse voltage source that alternately sets an electric potential of the electron emission surface between a first electric potential that is lower than the electric potential of the electrode or the specimen and a second electric potential that is higher than the first electric potential and is equal to or lower than the electric potential of the electrode or the specimen, and wherein:

the assist gas inlet is provided so that the assist gas is introduced in a direction which intersects the direction of emission of electrons emitted from the electron emission element; and the outlet is disposed so as to oppose to the assist gas inlet.

6. The mass spectrometer according to claim 4, further comprising:

an electrode that accelerates electrons emitted from the electron emission element toward the opening; and a pulse voltage source that alternately sets an electric potential of the electron emission surface between a first electric potential that is lower than the electric potential of the electrode or the specimen and a second electric potential that is higher than the first electric potential and is equal to or lower than the electric potential of the electrode or the specimen, and wherein:

the assist gas inlet is provided so that the assist gas is introduced in a direction which intersects the direction of emission of electrons emitted from the electron emission element;

the outlet is disposed so as to oppose to the assist gas inlet;

the outlet and the opening are disposed to be opposed to each other with respect to the electron emission element; and a penetration passage penetrating from a surface opposed to the opening to a surface opposed to the outlet is formed to the electron emission element disposed between the opening and the outlet.

7. The mass spectrometer according to claim 1, wherein the outlet is connected to the measurement unit in direct or via a sample transfer tube.

8. The mass spectrometer according to claim 7, wherein the measurement unit includes a connecting unit that can detachably attach to the outlet or the sample transfer tube.

9. The mass spectrometer according to claim 1, wherein a sealing member for sealing a clearance between the casing and the specimen is provided at the opening of the casing.

10. A sampling probe, comprising:

a casing having an opening that is opened to the atmosphere and an outlet through which a sample that has been obtained is discharged; and a surface emission type electron emission element housed in the casing such that an electron emission surface thereof opposes to the opening.

11. An analysis method, comprising:

placing a probe having an electron source so as to oppose to a specimen that is disposed in the atmosphere;

irradiating the specimen with an electron emitted from the electron source;

introducing a sample detached from the specimen to an analyzer; and analyzing the introduced sample.

* * * * *